US007689343B2

(12) United States Patent
Dagci et al.

(10) Patent No.: US 7,689,343 B2
(45) Date of Patent: Mar. 30, 2010

(54) METHOD AND APPARATUS FOR ENABLING CONTROL OF FUEL INJECTION FOR AN ENGINE OPERATING IN AN AUTO-IGNITION MODE

(75) Inventors: Oguz H. Dagci, Sterling Heights, MI (US); Jun-Mo Kang, Ann Arbor, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 202 days.

(21) Appl. No.: 11/739,155

(22) Filed: Apr. 24, 2007

(65) Prior Publication Data

US 2008/0264360 A1 Oct. 30, 2008

(51) Int. Cl.
*F02M 7/28* (2006.01)

(52) U.S. Cl. ..... 701/103; 701/111; 123/435; 123/406.47

(58) Field of Classification Search ..... 123/294, 123/305, 435, 436, 481, 406.14, 406.2, 406.22, 123/406.23, 406.24, 406.26, 406.27, 406.3, 123/406.41, 406.43, 406.47; 701/103–105, 701/111

See application file for complete search history.

(56) References Cited

U.S. PATENT DOCUMENTS 6,055,948 A 5/2000 Shiraishi et al.
6,286,482 B1 9/2001 Flynn et al.
6,615,129 B2 9/2003 Kabasin
6,644,017 B2 * 11/2003 Takahashi et al. ..... 60/285
6,662,785 B1 12/2003 Sloane et al.
6,758,177 B1 7/2004 McKay et al.
6,971,365 B1 12/2005 Najt et al.
6,994,072 B2 2/2006 Kuo et al.
7,059,281 B2 6/2006 Kuo et al.
7,063,068 B2 6/2006 Nakai et al.
7,077,084 B2 7/2006 Mallebrein
7,080,613 B2 7/2006 Kuo et al.
7,128,048 B2 10/2006 Yamaoka et al.
7,128,062 B2 10/2006 Kuo et al.
7,136,739 B2 * 11/2006 Miyata et al. ..... 701/104
7,213,572 B2 * 5/2007 Yang ..... 123/406.11
7,240,659 B2 * 7/2007 Yang ..... 123/295
7,243,532 B2 * 7/2007 Tsujimura et al. ..... 73/114.02
7,337,766 B2 * 3/2008 Nakayama et al. ..... 123/435
2006/0144356 A1 7/2006 Sellnau et al.
2006/0191513 A1 8/2006 Gray
2006/0196466 A1 9/2006 Kuo et al.

(Continued)

FOREIGN PATENT DOCUMENTS

JP 2004-190539 A 7/2004

(Continued)

*Primary Examiner*—Hai H Huynh

(57) ABSTRACT

There is provided a method and a control scheme to control an internal combustion engine operating in an auto-ignition mode by selectively activating a control scheme for controlling fuel injector operation based upon engine combustion parameters, e.g., IMEP or NMEP. The method comprises operating the engine in the auto-ignition combustion mode, and monitoring combustion in each of the cylinders. The fuel correction is selectively enabled only when either one of a partial burn and a misfire of a cylinder charge in one of the cylinders has been detected.

18 Claims, 5 Drawing Sheets

U.S. PATENT DOCUMENTS

| | | | |
|---|---|---|---|
| 2006/0196467 | A1 | 9/2006 | Kang et al. |
| 2006/0196468 | A1 | 9/2006 | Chang et al. |
| 2006/0196469 | A1 | 9/2006 | Kuo et al. |
| 2006/0236958 | A1 | 10/2006 | Sun et al. |
| 2006/0243241 | A1 | 11/2006 | Kuo et al. |

FOREIGN PATENT DOCUMENTS

| | | | |
|---|---|---|---|
| KR | 10-2006-0127812 | A | 12/2006 |
| KR | 10-2007-0011261 | A | 1/2007 |

* cited by examiner

METHOD AND APPARATUS FOR ENABLING CONTROL OF FUEL INJECTION FOR AN ENGINE OPERATING IN AN AUTO-IGNITION MODE

TECHNICAL FIELD

This invention relates to operation and control of homogeneous-charge compression-ignition (HCCI) engines.

BACKGROUND OF THE INVENTION

The statements in this section merely provide background information related to the present disclosure and may not constitute prior art.

Internal combustion engines, especially automotive internal combustion engines, generally fall into one of two categories, spark ignition engines and compression ignition engines. Traditional spark ignition engines, such as gasoline engines, typically function by introducing a fuel/air mixture into the combustion cylinders, which is then compressed in the compression stroke and ignited by a spark plug. Traditional compression ignition engines, such as diesel engines, typically function by introducing or injecting pressurized fuel into a combustion cylinder near top dead center (TDC) of the compression stroke, which ignites upon injection. Combustion for both traditional gasoline engines and diesel engines involves premixed or diffusion flames that are controlled by fluid mechanics. Each type of engine has advantages and disadvantages. In general, gasoline engines produce fewer emissions but are less efficient, while, in general, diesel engines are more efficient but produce more emissions.

More recently, other types of combustion methodologies have been introduced for internal combustion engines. One of these combustion concepts is known in the art as controlled auto-ignition, or homogeneous charge compression ignition (HCCI). Controlled auto-ignition comprises a distributed, flameless, auto-ignition combustion process that is controlled by oxidation chemistry, rather than by fluid mechanics. In a typical HCCI engine, the cylinder charge is nearly homogeneous in composition, temperature, and residual level at intake valve closing time. Because auto-ignition combustion is a distributed kinetically-controlled combustion process, an HCCI engine operates with a dilute fuel/air mixture (i.e., lean of a fuel/air stoichiometric point) and has a relatively low peak combustion temperature, thus forming extremely low $NO_x$ emissions. The fuel/air mixture for auto-ignition is relatively homogeneous, as compared to the stratified fuel/air combustion mixtures used in diesel engines, and, therefore, the rich zones that form smoke and particulate emissions in diesel engines are substantially eliminated. Because of this dilute fuel/air mixture, a HCCI engine can operate unthrottled to achieve diesel-like fuel economy.

At medium engine speed and load, a combination of valve profile and timing (e.g., exhaust recompression and exhaust re-breathing) and fueling strategy has been found to be effective in providing adequate heating to the cylinder charge so that auto-ignition during the compression stroke leads to stable combustion with low noise. One of the main issues in effectively operating an HCCI engine has been to control the combustion process properly so that robust and stable combustion resulting in low emissions, optimal heat release rate, and low noise can be achieved over a range of operating conditions. The benefits of auto-ignition combustion have been known for many years. The primary barrier to product implementation, however, has been the inability to control the auto-ignition combustion process.

To address issues related to combustion stability, HCCI engines operate at different combustion modes, depending upon specific engine operating conditions. The different combustion modes include various spark-ignition modes and auto-ignition modes.

The combustion process in an HCCI engine depends strongly on factors such as cylinder charge composition, temperature, and pressure at the intake valve closing. Hence, the control inputs to the engine, for example, fuel mass and injection timing and intake/exhaust valve profile, must be carefully coordinated to ensure robust auto-ignition combustion. Generally speaking, for best fuel economy, an HCCI engine operates unthrottled and with a lean air-fuel mixture. Further, in an HCCI engine using exhaust recompression valve strategy, the cylinder charge temperature is controlled by trapping different amount of the hot residual gas from the previous cycle by varying the exhaust valve close timing. The opening timing of the intake valve is delayed than normal to a later time preferably symmetrical to the exhaust valve closing timing about top-dead-center (TDC) intake. Both the cylinder charge composition and temperature are strongly affected by the exhaust valve closing timing. In particular, more hot residual gas from a previous cycle is retained with earlier closing of the exhaust valve which leaves less room for incoming fresh air mass. The net effects are higher cylinder charge temperature and lower cylinder oxygen concentration.

For a single cylinder engine, it has been demonstrated that by adjusting both intake/exhaust valve profiles and engine control inputs such as injection mass and timing, spark timing, throttle and EGR valve positions combustion phasing control and robust auto-ignition combustion can be achieved using either a fully flexible valve actuation (FFVA) system or a mechanical two-step variable valve lift control scheme with a dual cam phasing system. However, in a multi-cylinder HCCI engine, combustion in each cylinder can vary significantly due to the difference in temperature caused by air, EGR and thermal mal-distributions. To compensate for such variations in cylinders and to stabilize the auto-ignited combustion, fuel quantity at each individual cylinder may be controlled.

In an HCCI engine, temperature at intake valve closing at each cylinder is critical since it determines the stability of combustion especially during transients. During transients, if the temperature at intake valve closing is too low at a particular cylinder, either misfire or partial burn, which may cause undesired drivability problems can occur at that cylinder. The combustion related parameters measured during transients are reliable indicators if the temperature at intake valve closing at a particular cylinder is too low.

A system which detects the cases wherein the temperature at intake valve closing is too low is now described.

SUMMARY OF THE INVENTION

In accordance with an embodiment of the invention, there is provided a method and a control scheme to control an internal combustion engine operating in an auto-ignition mode by selectively activating a control scheme for controlling fuel injector operation based upon engine combustion parameters, e.g., IMEP or NMEP. The method comprises operating the engine in the auto-ignition combustion mode, and monitoring combustion in each of the cylinders. The fuel correction is selectively enabled only when either one of a partial burn and a misfire of a cylinder charge in one of the cylinders has been detected.

After processing the combustion related measurements, if certain conditions are met and misfire or partial burn is detected, the proposed system enables a fast high-gain fuel injection correction algorithm to recover from the misfire/partial burn and further to prevent future misfire/partial burn. The fuel correction algorithm reacts quickly to undesired misfires/partial burns as (e.g., in a fast loop) with sufficient amount of correction fuel (high gain controller). The proposed method determines the conditions when such a fast high-gain fuel correction is needed.

These and other aspects of the invention are described hereinafter with reference to the drawings and the description of the embodiments.

DESCRIPTION OF THE DRAWINGS

The invention may take physical form in certain parts and arrangement of parts, the embodiments of which are described in detail and illustrated in the accompanying drawings which form a part hereof, and wherein.

DESCRIPTION OF EMBODIMENTS OF THE INVENTION

Figure 1:
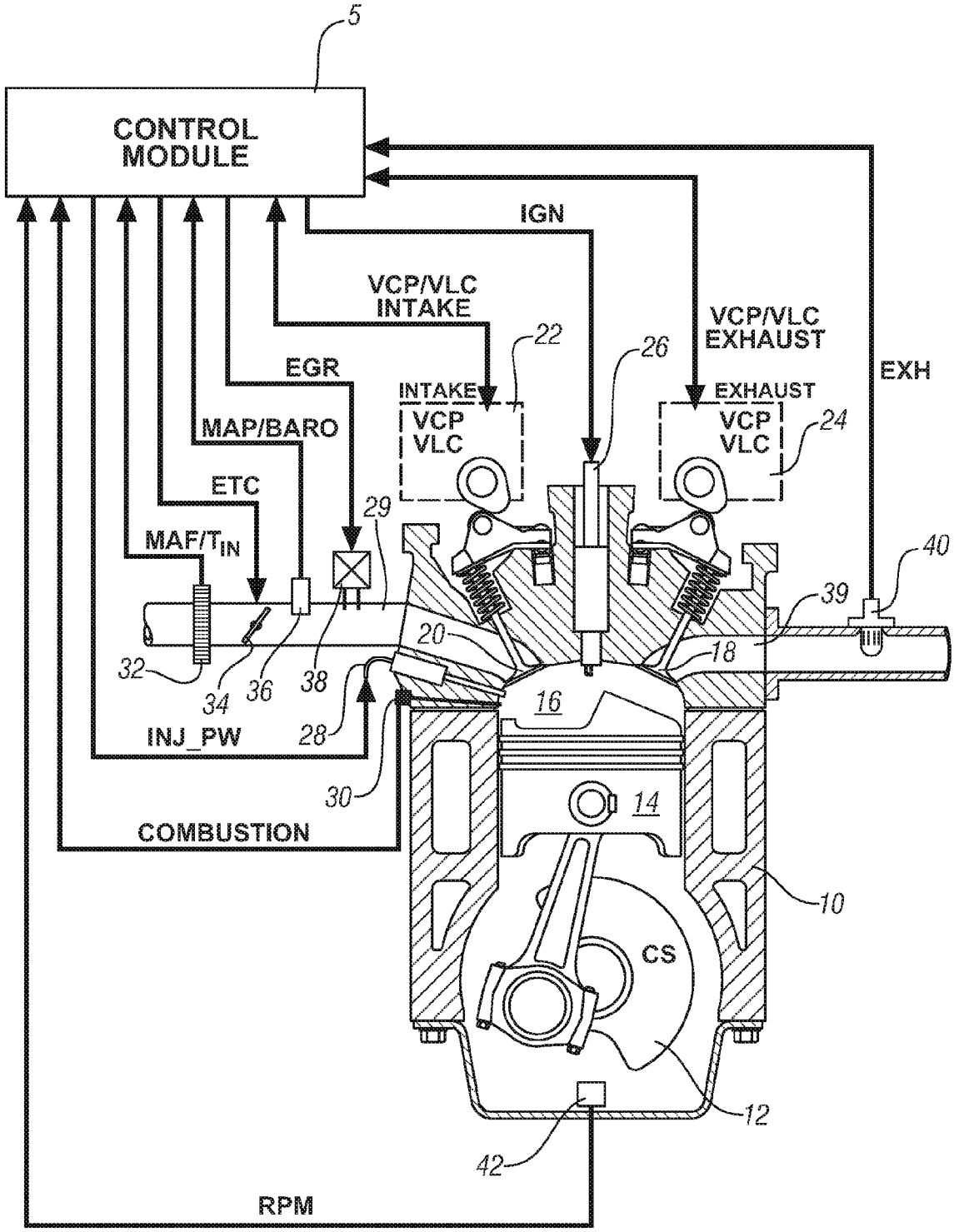
FIG. 1 is a schematic drawing of an engine system, in accordance with the present invention; and, FIGS. 2-6 are algorithmic flow diagrams, in accordance with the present invention.

Referring now to the drawings, wherein the depictions are for the purpose of illustrating the invention only and not for the purpose of limiting the same, FIG. 1 depicts a schematic diagram of an internal combustion engine 10 and accompanying control module that have been constructed in accordance with an embodiment of the invention. The engine is selectively operative in a controlled auto-ignition mode and a conventional spark-ignition mode.

The exemplary engine 10 comprises a multi-cylinder direct-injection four-stroke internal combustion engine having reciprocating pistons 14 slidably movable in cylinders which define variable volume combustion chambers 16. Each of the pistons is connected to a rotating crankshaft 12 ('CS') by which their linear reciprocating motion is translated to rotational motion. There is an air intake system which provides intake air to an intake manifold which directs and distributes the air into an intake runner 29 to each combustion chamber 16. The air intake system comprises airflow ductwork and devices for monitoring and controlling the air flow. The devices preferably include a mass airflow sensor 32 for monitoring mass airflow ('MAF') and intake air temperature ('$T_{IN}$'). There is a throttle valve 34, preferably an electronically controlled device which controls air flow to the engine in response to a control signal ('ETC') from the control module. There is a pressure sensor 36 in the manifold adapted to monitor manifold absolute pressure ('MAP') and barometric pressure ('BARO'). There is an external flow passage for recirculating exhaust gases from engine exhaust to the intake manifold, having a flow control valve, referred to as an exhaust gas recirculation ('EGR') valve 38. The control module 5 is operative to control mass flow of exhaust gas to the engine air intake by controlling opening of the EGR valve.

Air flow from the intake runner 29 into each of the combustion chambers 16 is controlled by one or more intake valves 20. Flow of combusted gases from each of the combustion chambers to an exhaust manifold via exhaust runners 39 is controlled by one or more exhaust valves 18. Openings and closings of the intake and exhaust valves are preferably controlled with a dual camshaft (as depicted), the rotations of which are linked and indexed with rotation of the crankshaft 12. The engine is equipped with devices for controlling valve lift of the intake valves and the exhaust valves, referred to as variable lift control ('VLC'). The variable valve lift system comprises devices operative to control valve lift, or opening, to one of two distinct steps, e.g., a low-lift valve opening (about 4-6 mm) for load speed, low load operation, and a high-lift valve opening (about 8-10 mm) for high speed and high load operation. The engine is further equipped with devices for controlling phasing (i.e., relative timing) of opening and closing of the intake valves and the exhaust valves, referred to as variable cam phasing ('VCP'), to control phasing beyond that which is effected by the two-step VLC lift. There is a VCP/VLC system 22 for the engine intake and a VCP/VLC system 24 for the engine exhaust. The VCP/VLC systems 22, 24 are controlled by the control module, and provide signal feedback to the control module consisting of camshaft rotation position for the intake camshaft and the exhaust camshaft. When the engine is operating in auto-ignition mode with exhaust recompression valve strategy the low lift operation is typically used, and when the engine is operating in a spark-ignition combustion mode the high lift operation typically is used. As known to skilled practitioners, VCP/VLC systems have a limited range of authority over which opening and closings of the intake and exhaust valves can be controlled. Variable cam phasing systems are operable to shift valve opening time relative to crankshaft and piston position, referred to as phasing. The typical VCP system has a range of phasing authority of 30°-50° of cam shaft rotation, thus permitting the control system to advance or retard opening and closing of the engine valves. The range of phasing authority is defined and limited by the hardware of the VCP and the control system which actuates the VCP. The VCP/VLC system is actuated using one of electro-hydraulic, hydraulic, and electric control force, controlled by the control module 5.

The engine includes a fuel injection system, comprising a plurality of high-pressure fuel injectors 28 each adapted to directly inject a mass of fuel into one of the combustion chambers, in response to a signal ('INJ_PW') from the control module. The fuel injectors 28 are supplied pressurized fuel from a fuel distribution system (not shown).

The engine includes a spark ignition system by which spark energy is provided to a spark plug 26 for igniting or assisting in igniting cylinder charges in each of the combustion chambers, in response to a signal ('IGN') from the control module. The spark plug 26 enhances the ignition timing control of the engine at certain conditions (e.g., during cold start and near a low load operation limit).

The engine is equipped with various sensing devices for monitoring engine operation, including a crankshaft rotational speed sensor 42 having output RPM, a combustion sensor 30 adapted to monitor combustion having output COMBUSTION, and, an exhaust gas sensor 40 adapted to monitor exhaust gases having output EXH, typically a wide range air/fuel ratio sensor. The combustion sensor 30 comprises a sensor device operative to determine an engine operating state from which a state of a combustion parameter is determined. The combustion sensor is depicted as a pressure sensor adapted to monitor in-cylinder combustion pressures. The control module preferably includes signal processing algorithms and circuitry which are adapted to capture and process signal outputs from the pressure sensor to derive a state for a combustion parameter of mean-effective-pressure (IMEP) for each cylinder. Preferably, the engine and control system are mechanized to monitor and determine states of IMEP for each of the engine cylinders during each cylinder firing event. Alternatively, other sensing systems can be used to monitor states of other combustion parameters within the scope of the invention, e.g., ion-sense ignition systems.

The engine is designed to operate un-throttled on gasoline or similar fuel blends with controlled auto-ignition combustion over an extended range of engine speeds and loads. However spark ignition and throttle-controlled operation may be utilized with conventional or modified control methods under conditions not conducive to the auto-ignition operation and to obtain maximum engine power to meet an operator torque request. Fueling preferably comprises direct fuel injection into the each of the combustion chambers. Widely available grades of gasoline and light ethanol blends thereof are preferred fuels; however, alternative liquid and gaseous fuels such as higher ethanol blends (e.g. E80, E85), neat ethanol (E99), neat methanol (M100), natural gas, hydrogen, biogas, various reformates, syngases, and others may be used in the implementation of the present invention.

The control module 5 is preferably a general-purpose digital computer generally comprising a microprocessor or central processing unit, storage mediums comprising non-volatile memory including read only memory (ROM) and electrically programmable read only memory (EPROM), random access memory (RAM), a high speed clock, analog to digital (A/D) and digital to analog (D/A) circuitry, and input/output circuitry and devices (I/O) and appropriate signal conditioning and buffer circuitry. The control module has a set of control algorithms, comprising resident program instructions and calibrations stored in the non-volatile memory and executed to provide the respective functions of each computer. The algorithms are typically executed during preset loop cycles such that each algorithm is executed at least once each loop cycle. Algorithms are executed by the central processing unit and are operable to monitor inputs from the aforementioned sensing devices and execute control and diagnostic routines to control operation of the actuators, using preset calibrations. Loop cycles are typically executed at regular intervals, for example each 3.125, 6.25, 12.5, 25 and 100 milliseconds during ongoing engine and vehicle operation. Alternatively, algorithms may be executed in response to occurrence of an event.

The control module 5 executes algorithmic code stored therein to control the aforementioned actuators to control engine operation, including throttle position, spark timing, fuel injection mass and timing, intake and/or exhaust valve timing and phasing, and EGR valve position to control flow of recirculated exhaust gases. Valve timing and phasing includes negative valve overlap (NVO in an exhaust recompression strategy) and lift of exhaust valve reopening (in an exhaust re-breathing strategy). The control module is adapted to receive input signals from an operator (e.g., a throttle pedal position and a brake pedal position) to determine an operator torque request ($T_{O_REQ}$) and from the sensors indicating the engine speed (RPM) and intake air temperature ($T_{IN}$), and coolant temperature and other ambient conditions. The control module 5 operates to determine, from lookup tables in memory, instantaneous control settings for spark timing (as needed), EGR valve position, intake and exhaust valve timing and/or lift set points, and fuel injection timing, and calculates the burned gas fractions in the intake and exhaust systems.

Figure 2:
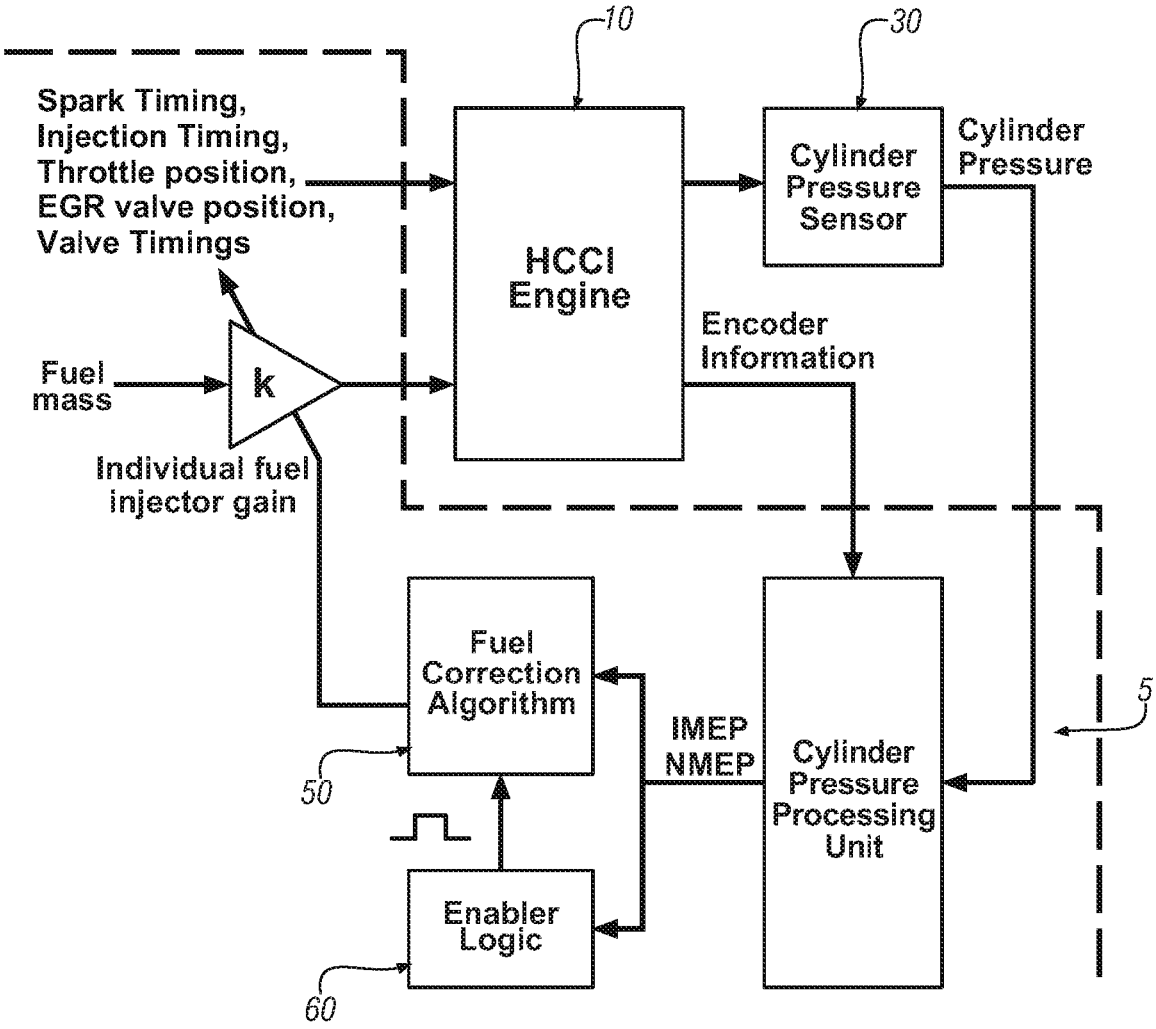

Referring now to FIG. 2, a schematic diagram depicts overall operation of the system. Inputs to the engine 10 are depicted as fuel mass, and other controls. The fuel mass is determined based upon engine operating characteristics and the operator torque request, and selectively corrected using individual fuel injector gain factors, K, derived by a fuel correction algorithm 50 when it is enabled by the enabler logic described hereinafter. The other controls comprise the aforementioned instantaneous control settings for spark timing (as needed), EGR valve position, and intake and exhaust valve timing and/or lift set points, and injected fuel timing. Signals output from the cylinder pressure sensors 30 are monitored, and input to a cylinder pressure processing unit, from which state values for IMEP for each of the cylinders is determined each firing event. The state values for IMEP for each of the cylinders determined each firing event are input to the enabler logic and the fuel correction algorithm 50. Under specific conditions described hereinbelow, the enabler logic enables the fuel correction algorithm to output individual fuel injector gains to control actuation of the fuel injectors. The fuel correction algorithm 50 comprises any one of a variety of fuel correction schemes which is operative to adjust the gains of the individual fuel injectors to correct the amount of fuel injected in each of the cylinders. The intended result is to minimize misfires/partial burns due to the low temperature at intake valve closing by adjusting fuel during transients for each cylinder. The overall engine fueling strategy comprises controlling the total fuel injected from all injectors into the engine to be equal to the commanded value so that the engine torque follows the operator torque request. The engine fueling strategy and the fuel correction scheme are outside the scope of the invention.

One example of a fuel correction algorithm includes a method, executed in the control module as algorithmic code, having two elements, including a global fuel injector adaptation algorithm, which controls fuel flow through all the engine injectors based on MAF and air-fuel ratio measurements, and, an individual fuel injector adaptation algorithm which controls fuel flow through each injector based on combustion phasing measurements, e.g., as measured by IMEP. The individual fuel injector adaptation algorithm corrects output of each of the fuel injectors. The fuel injectors typically have different flow injection characteristics, due to fuel rail pressure pulsation, manufacturing tolerance, injector fouling, and other factors. The different characteristics between individual injectors can cause partial burns or misfires due to the differences between commanded and delivered fuel quantities. For example, when fuel is injected less than the commanded into a cylinder, either misfire or partial burn can occur in the cylinder due to low residual gas temperature.

Figure 3:
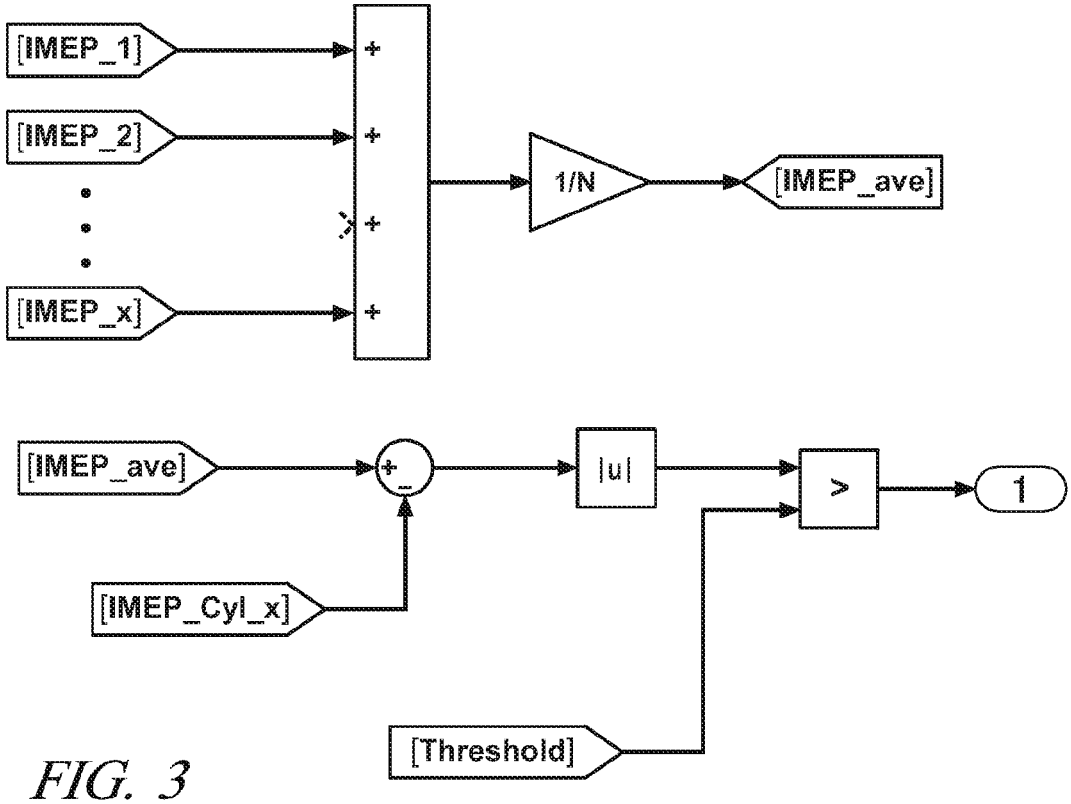

Referring now to FIGS. 3 through 6, schematic diagrams of the enabler logic are now described. In FIG. 3, each of the individual states for IMEP for the cylinders (IMEP_1, IMEP_2, . . . IMEP_x) are added and an average IMEP, IMEP_ave is determined. Absolute values of differences between the average IMEP and each of the individual IMEP states are each compared to a threshold, and the result is digitally filtered, as depicted with reference to FIG. 4. The enabler logic for the fuel correction algorithm takes the IMEP measurements of each cylinder as inputs at each firing event. The logic enables the fuel correction algorithm only when either partial-burn or misfire is detected from the IMEP measurements, as indicated by a deviation from the average value for IMEP.

Referring to FIG. 3, the average value for IMEP (IMEP_ave) is calculated, and becomes the baseline to which each cylinder's IMEP is compared. Each cylinder's IMEP is subtracted from IMEP_ave. After the absolute value of the result is taken, it is compared to a threshold, which is a calibration parameter. When the threshold is smaller than the absolute value, the fuel correction algorithm 50 is commanded to be activated.

The command to activate the fuel correction algorithm is subject to further analysis, described with reference to FIGS.

Figure 4:
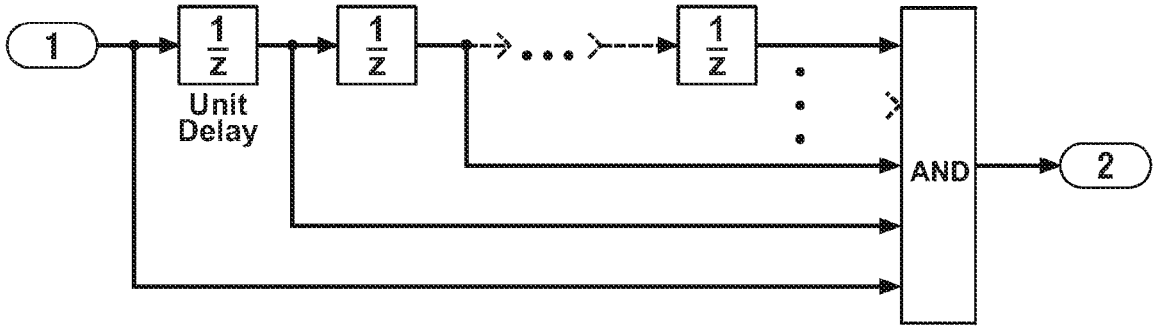

4, 5 and 6. The activation command is digitally filtered using a filter depicted with reference to FIG. 4. The filtering activity causes the enabler logic to ignore an activation command when a deviation from the average IMEP lasts less than a calibratable number of cycles. The number of event delays in the filter is calibratable. The filter output of FIG. 4 is input as described below with reference to FIG. 6.

The enabler logic disables the fuel correction algorithm when auto-ignited combustion is oscillatory, i.e., when the IMEP of at least one of the cylinders varies significantly for a certain amount of time. Such an operating condition occurs when the engine operates near the boundary of auto-ignited combustion, especially at low load and low engine speed conditions.

Figure 5:
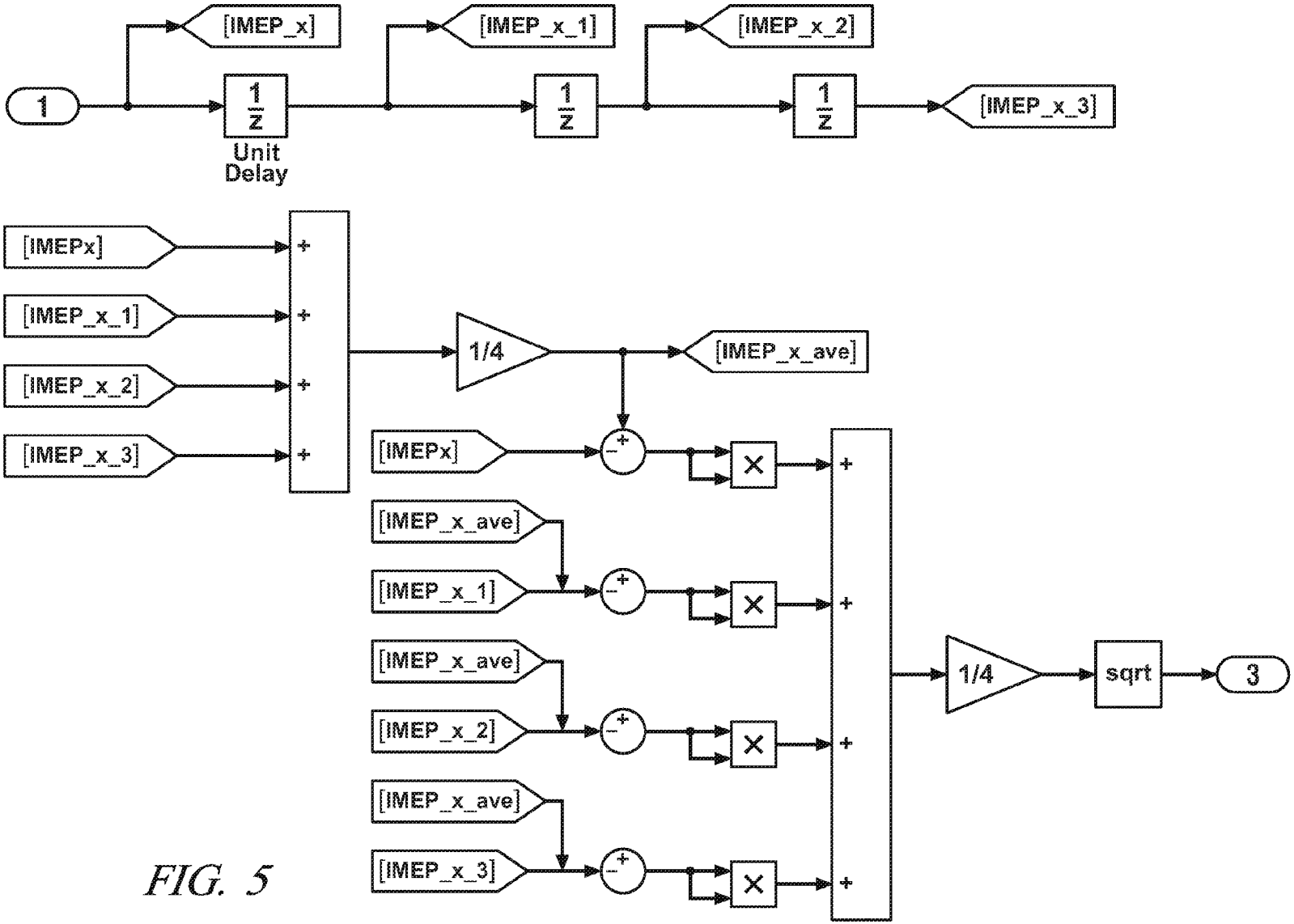

Referring now to FIG. 5, a second portion of the algorithm which overwrites the output of the aforementioned algorithm is described. As depicted, a standard deviation for IMEP for each cylinder is calculated at the end of each cylinder's firing event. The current and last three IMEP states for each of the cylinders (IMEP_x, IMEP_x_1, IMEP_x_2, IMEP_x_3) are captured and stored in short-term memory, utilizing a virtual moving window capable of storing the four IMEP measurements of each cylinder 'x' to calculate the standard deviation. The standard deviation is depicted as output '3' in FIG. 5, which become inputs (stddev_IMEP_1, stddev_IMEP_2 . . . stddev_IMEP_x) to FIG. 6.

Figure 6:
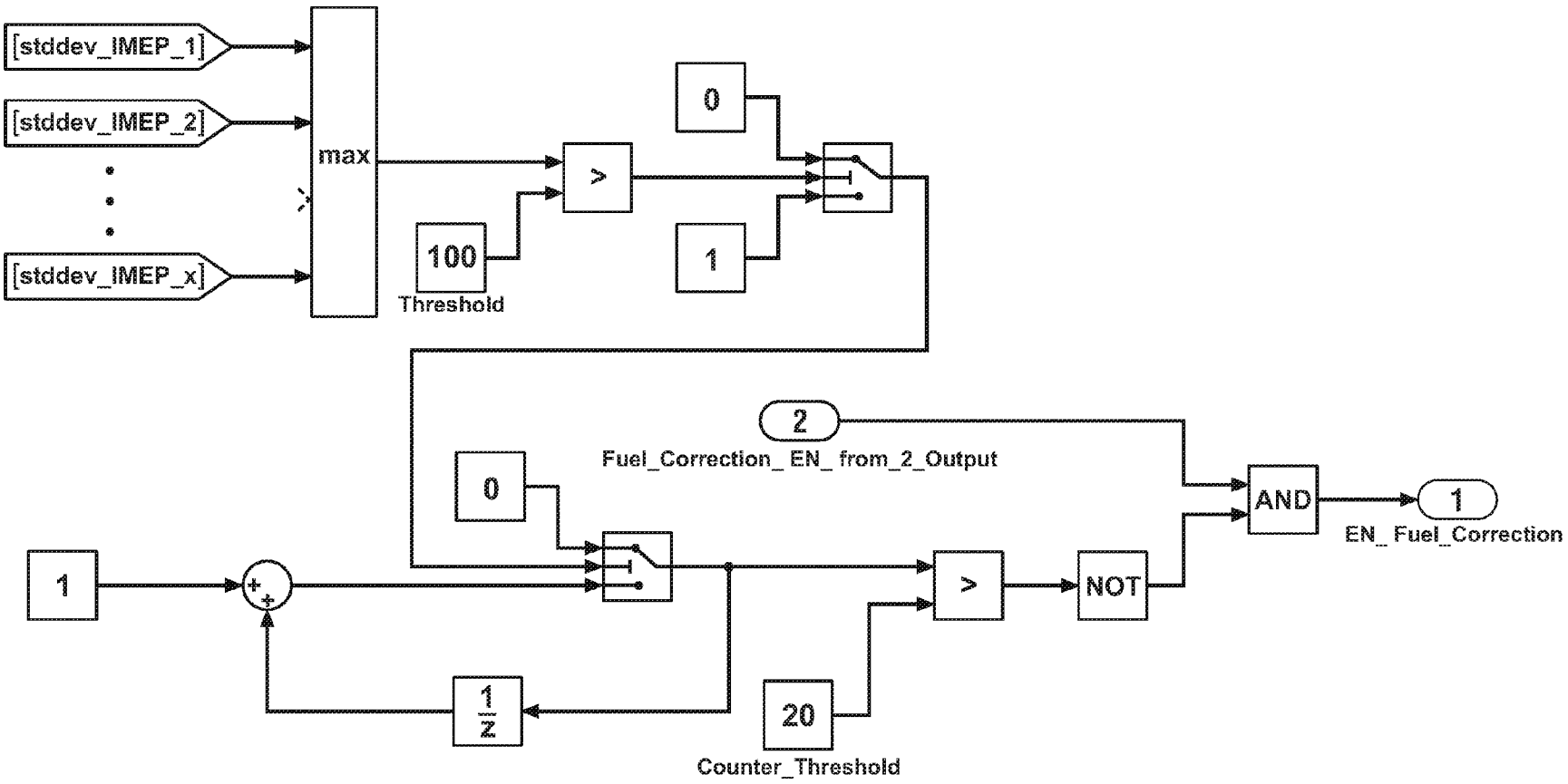

Referring now to FIG. 6, after the calculation of each cylinder's IMEP standard deviation, a maximum standard deviation of all the cylinders is identified, and compared to a calibratable threshold, depicted as '100'. When the maximum standard deviation exceeds the threshold, a counter is triggered. The counter starts from zero and increments at every firing event as long as the new maximum standard deviation is greater than the threshold. When the counter reaches a predetermined limit, i.e. Counter_Threshold, depicted as having a threshold value of 20, then the output of the logic becomes zero, through the logic sequence depicted. The output of the aforementioned logic is logically ANDed with the output of the algorithms described in FIGS. 3 and 4, i.e., Fuel_Correction_EN_from_2_Output. The purpose of this algorithm is to deactivate the fuel correction algorithm 50 when unstable combustion occurs in all the cylinders. As soon as the maximum standard deviation goes below the threshold, the counter is reset back to 0 and the algorithm provides 1 to its output, i.e. fuel correction algorithm can be enabled by the logic described in FIGS. 3 and 4. This portion of the algorithm acts to lock and unlock the fuel correction algorithm, with the output signal (EN_Fuel_Correction) enabling or disabling the fuel correction algorithm.

While the invention has been described by reference to certain embodiments, it should be understood that changes can be made within the spirit and scope of the inventive concepts described. Accordingly, it is intended that the invention not be limited to the disclosed embodiments, but that it have the full scope permitted by the language of the following claims.

The invention claimed is:

1. Method for operating a multi-cylinder internal combustion engine selectively operative in one of a spark-ignition mode and an auto-ignition mode, the method comprising:

operating the engine in the auto-ignition combustion mode;

monitoring combustion in each of the cylinders comprising measuring combustion during each firing event, and determining a state for a combustion parameter for each of the firing events therefrom; and selectively enabling fuel correction to the cylinders only when either one of a partial burn and a misfire of a cylinder charge in one of the cylinders has been detected based upon the monitored combustion.

2. The method of claim 1, wherein monitoring combustion in each of the cylinders further comprises measuring in-cylinder pressure, and determining a state for cylinder mean-effective-pressure therefrom.

3. The method of claim 1, further comprising:

calculating an average of the states of the combustion parameter for the cylinders; and detecting one of a partial burn and a misfire in one of the cylinders when the determined state for the combustion parameter for one of the cylinders varies from the average of the states of the combustion parameter by an amount greater than a threshold.

4. The method of claim 1, further comprising:

determining a plurality of states for the combustion parameter for each cylinder during successive firing events based upon the monitored combustion in each of the cylinders;

calculating a deviation for the states of the combustion parameter for each cylinder;

determining a maximum deviation for all of the cylinders; and, disabling the fuel correction when the maximum deviation for all the cylinders exceeds a threshold.

5. The method of claim 4, further comprising disabling the fuel correction when the maximum deviation for all the cylinders exceeds a threshold for a predetermined number of firing events.

6. The method of claim 1, wherein selectively enabling fuel correction comprises enabling an algorithm to correct fueling rate to one of the cylinders to stabilize combustion while operating in the auto-ignition mode.

7. The method of claim 6, wherein the algorithm to correct fueling rate to one of the cylinders to stabilize combustion while operating in the auto-ignition mode comprises:

determining engine combustion phasing for each of the cylinders based upon the monitored combustion in each of the cylinders;

globally adapting fuel injector pulsewidths based upon engine intake mass air flow and an exhaust air/fuel ratio; and, selectively adjusting individual fuel injector pulsewidths to achieve combustion with minimum misfires and partial burns.

8. Method for controlling a multi-cylinder internal combustion engine operating in an auto-ignition mode, the method comprising:

measuring in-cylinder pressure in each of the cylinders, and determining a state for cylinder mean-effective-pressure therefrom for each firing event;

calculating an average state for the cylinder mean-effective-pressure for all the cylinders for each firing event;

detecting one of a partial burn and a misfire in one of the cylinders when the cylinder mean-effective-pressure for one of the cylinders varies from the average state for the cylinder mean-effective-pressure by an amount greater than a threshold; and, selectively enabling individual cylinder fuel correction when either one of a partial burn and a misfire of a cylinder charge in one of the cylinders has been detected.

9. The method of claim 8, wherein selectively enabling individual cylinder fuel correction when either one of a partial burn and a misfire in one of the cylinders has been detected based upon the monitored combustion further comprises:

determining a state for mean-effective pressure for each of the cylinders during each firing event;

calculating an average of the states of the mean-effective pressure for the cylinders;

detecting one of a partial burn and a misfire in one of the cylinders when the determined state for the mean-effective pressure for one of the cylinders varies from the average of the states for the mean-effective pressure by an amount greater than a threshold.

10. The method of claim 8, further comprising:

determining a plurality of states for the mean-effective pressure for each of the cylinders during successive firing events;

calculating a deviation for the states of the mean-effective pressure for each of the cylinders;

determining a maximum deviation in the mean-effective pressure for all of the cylinders;

disabling the fuel correction when the maximum deviation in the mean-effective pressure for all the cylinders exceeds a threshold; and, disabling the fuel correction when the maximum deviation mean-effective pressure for all the cylinders exceeds a threshold for a predetermined number of firing events.

11. The method of claim 8, wherein selectively enabling fuel correction comprises enabling an algorithm to correct fueling rate to one of the cylinders to stabilize combustion in the engine while operating in the auto-ignition mode.

12. The method of claim 11, wherein the algorithm to correct fueling rate to one of the cylinders to stabilize combustion in the engine while operating in the auto-ignition mode comprises:

determining engine combustion phasing for each of the cylinders based upon the mean-effective pressure in each of the cylinders;

globally adapting fuel injector pulsewidths based upon engine intake mass air flow and an exhaust air/fuel ratio; and, selectively adjusting individual fuel injector pulsewidths to achieve stable combustion with minimum misfires and partial burns.

13. Method for controlling a multi-cylinder internal combustion engine selectively operative in one of a spark-ignition mode and an auto-ignition mode, the method comprising:

monitoring an operator torque request;

selectively operating the engine in the auto-ignition mode based upon engine operating conditions and the operator torque request;

monitoring combustion in each of the cylinders, and, determining a state for a combustion parameter therefrom for each firing event;

calculating an average state for the combustion parameter for all of the cylinders for each firing event;

detecting one of a partial burn and a misfire when the combustion parameter of one of the cylinders varies from the average state for the combustion parameter by an amount greater than a threshold;

selectively enabling fuel correction when either one of a partial burn and a misfire of a cylinder charge in one of the cylinders has been detected, and;

selectively deactivating the fuel correction when either one of a partial burn and a misfire occurs in all the cylinders.

14. The method of claim 13, wherein selectively enabling fuel correction only when either one of a partial burn and a misfire of a cylinder charge in one of the cylinders has been detected based upon the monitored combustion parameter further comprises:

determining a state for the combustion parameter for each of the cylinders during each firing event;

calculating an average of the states of the combustion parameter for the cylinders;

detecting one of a partial burn and a misfire of a cylinder charge in one of the cylinders when the determined state for the combustion parameter for one of the cylinders varies from the average of the states for the combustion parameter by an amount greater than a threshold.

15. The method of claim 14, further comprising:

determining a plurality of states for the combustion parameter for each of the cylinders during successive firing events based upon the monitored combustion in each of the cylinders;

calculating a deviation for the states of the combustion parameter for each of the cylinders;

determining a maximum deviation for all of the cylinders;

disabling the fuel correction when the maximum deviation for all the cylinders exceeds a threshold; and, disabling the fuel correction when the maximum deviation for all the cylinders exceeds a threshold for a predetermined number of firing events.

16. The method of claim 15, wherein selectively enabling fuel correction comprises enabling an algorithm to correct fueling rate to one of the cylinders to stabilize combustion in the engine while operating in the auto-ignition mode.

17. The method of claim 16, wherein the algorithm to correct fueling rate to one of the cylinders to stabilize combustion in the engine while operating in the auto-ignition mode comprises:

determining engine combustion phasing for each of the cylinders based upon the monitored combustion in each of the cylinders;

globally adapting fuel injector pulsewidths based upon engine intake mass air flow and an exhaust air/fuel ratio; and, selectively adjusting individual fuel injector pulsewidths to achieve combustion with minimum misfires and partial burns.

18. The method of claim 17, wherein monitoring combustion in each of the cylinders comprises measuring in-cylinder pressure, and determining a state for cylinder mean-effective-pressure therefrom.

* * * * *